US012516533B1

(12) United States Patent
Blizzard

(10) Patent No.: US 12,516,533 B1
(45) Date of Patent: Jan. 6, 2026

(54) METHODS AND DEVICES FOR REPAIRING CONCRETE SURFACES

(71) Applicant: D.A. Collins Construction Co., Inc., Wilton, NY (US)

(72) Inventor: Kenneth T. Blizzard, Fort Ann, NY (US)

(73) Assignee: D. A. COLLINS CONSTRUCTION CO., INC., Wilton, NY (US)

( * ) Notice: Subject to any disclaimer, the term of this patent is extended or adjusted under 35 U.S.C. 154(b) by 170 days.

(21) Appl. No.: 18/534,910

(22) Filed: Dec. 11, 2023

Related U.S. Application Data

(60) Provisional application No. 63/476,936, filed on Dec. 22, 2022.

(51) Int. Cl.
*E04G 23/02* (2006.01)
*E01D 22/00* (2006.01)

(52) U.S. Cl.
CPC ..... *E04G 23/0203* (2013.01); *E01D 22/00* (2013.01)

(58) Field of Classification Search
CPC . E04G 23/0203; E04G 23/0296; E04G 23/02; E04G 23/0214; E04G 23/0229; E04G 23/0207; E04G 21/02; E04G 21/025; E04G 21/04; E04G 21/0481; F16B 2200/00; E01D 22/00; B65G 11/18
See application file for complete search history.

(56) References Cited

U.S. PATENT DOCUMENTS 2,074,566 A 3/1937 Sheils
3,764,222 A * 10/1973 Orthman ..... E04G 21/205 222/144.5
4,285,183 A * 8/1981 Condit ..... E04G 23/0207 52/514
4,370,842 A * 2/1983 Martin ..... E04G 23/02 52/514

(Continued)

FOREIGN PATENT DOCUMENTS

EP 0169170 A2 1/1986
EP 0658659 A1 6/1995
SE 469527 B 7/1993

OTHER PUBLICATIONS

Hamilton, "How to Fill a Hole in the Exterior Concrete Wall of a Home Before Painting," SFGSATE News Website, www.sfgate.com, 2018, 4 pages.

*Primary Examiner* — Jessica L Laux
(74) *Attorney, Agent, or Firm* — Tech Valley Patent, LLC; John Pietrangelo

(57) ABSTRACT

Methods for repairing holes in a surface, for example, in a concrete surface, cement slurry hoppers, cement slurry funnels, and cement slurry hopper assemblies are disclosed. The methods include positioning a barrier, such as, a board, over a hole in a surface wherein a portion of the hole is not covered by the barrier and a cavity is formed behind the barrier; mounting a hopper over the portion of the hole not covered by the barrier; pouring a cement slurry into the open top of the hopper to substantially completely fill the cavity with cement slurry; allowing the cement slurry to harden; and then removing the hopper and barrier from the surface to reveal a repaired hole in the surface. A cement slurry funnel may be used to fill the hopper. The cement slurry hopper and the cement slurry hopper assembly having an isolation plate are also provided.

20 Claims, 14 Drawing Sheets

(56) References Cited

U.S. PATENT DOCUMENTS

| | | | | |
|---|---|---|---|---|
| 4,409,764 | A | 10/1983 | Wilnau | |
| 4,809,478 | A | 3/1989 | Bernard | |
| 5,186,299 | A | 2/1993 | Stimson | |
| 5,450,700 | A | 9/1995 | Hackman | |
| 5,665,045 | A * | 9/1997 | Brucker | B65D 25/525 29/434 |
| 5,732,753 | A * | 3/1998 | Danzi | E04G 21/025 52/DIG. 1 |
| 6,460,581 | B1 | 10/2002 | Marshall | |
| 6,868,953 | B1 | 3/2005 | Thompson | |
| 7,007,821 | B2 * | 3/2006 | Aylward | B33Y 80/00 221/289 |
| 7,665,272 | B2 * | 2/2010 | Reen | E04G 23/0203 52/220.8 |
| 8,267,608 | B1 | 9/2012 | Wheeler et al. | |
| 8,336,585 | B2 | 12/2012 | Royce | |
| 8,381,474 | B2 * | 2/2013 | Lewis | E04G 23/0207 52/746.1 |
| 8,485,234 | B2 * | 7/2013 | Pfaff | B67C 11/02 141/340 |
| 8,511,029 | B2 * | 8/2013 | Hansen | E04G 23/0203 52/746.1 |
| 9,233,795 | B2 * | 1/2016 | Gustafson | B65G 11/18 |
| 9,796,623 | B2 * | 10/2017 | Horton | E04G 23/0207 |
| 10,974,942 | B1 * | 4/2021 | Donton, Sr. | E04G 21/0481 |
| 2006/0096220 | A1 | 5/2006 | Greer, Jr. et al. | |
| 2009/0229706 | A1 | 9/2009 | Royce | |
| 2012/0047845 | A1 | 3/2012 | Lest | |
| 2012/0291917 | A1 * | 11/2012 | Bera | B28B 7/0002 141/391 |

* cited by examiner

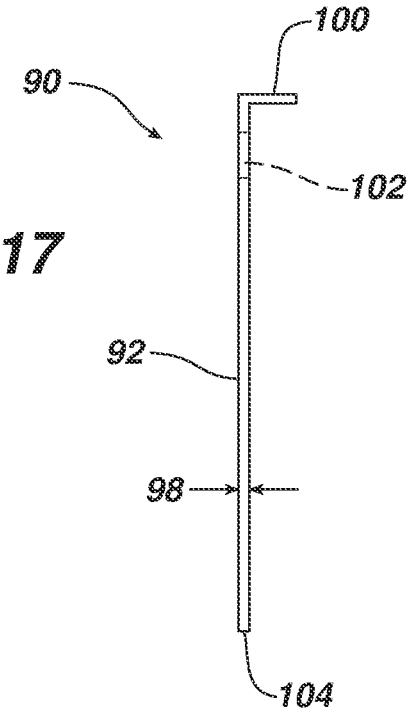
FIG. 17
FIG. 18
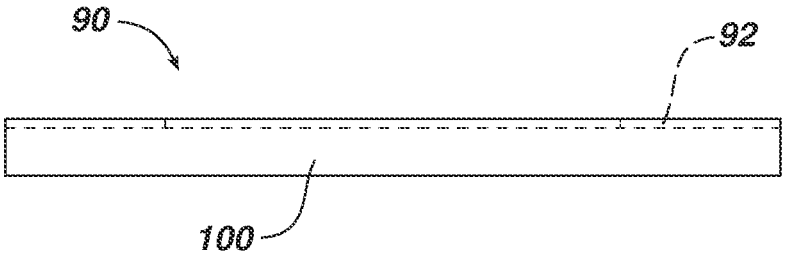

METHODS AND DEVICES FOR REPAIRING CONCRETE SURFACES

CROSS-REFERENCE TO RELATED APPLICATION

This application claims priority from U.S. Provisional Patent Application 63/476,936, filed on Dec. 22, 2022, the disclosure of which is included by reference herein in its entirety.

BACKGROUND OF THE INVENTION

Technical Field

This invention is generally related to methods and devices for repairing surfaces having undesirable holes or cavities, for example, concrete surfaces. Specifically, aspects of the invention include methods and devices for repairing concreate walls that over time may deteriorate leaving cavities that require repair, for example, concrete walls supporting infrastructure, for instance, roadways and bridges.

Description of Related Art

The maintenance of our nation's roadways and bridges typically requires substantially continuous attention and, often, repair. Environmental exposure, including rain, snow, salt, and fluctuating temperature, may cause aging structural supports to decay or fail, for example, by spalling, by cracking, and/or by other forms of deterioration, producing undesirable imperfections and/or cavities in surfaces. These surfaces cavities often requiring repair to reestablish structural strength and/or to return the surfaces to an aesthetically pleasing appearance.

Conventionally, undesirable imperfections and cavities can be repaired by filling the imperfections or cavities with a slurry of concrete, for example, manually with a trowel, and allowing the concrete to harden or cure. Larger cavities in concrete walls, for example, larger cavities on vertically-oriented concrete walls, may often be first covered with a board, for example, a sheet of plywood forming a cavity between the board and surface of the cavity into which the concreate slurry may be poured, and, after the concrete hardens, the board is removed revealing the repaired concrete surface. The preliminary hardened concrete surface may require minor treatment or "touch-up" to provide the desired continuity or surface appearance.

Though existing methods of repairing concrete walls are entirely adequate for repairing concrete walls and structures, existing practices can be tedious and time consuming. Embodiments of the present invention provide methods and devices for preparing such surfaces, for example, surfaces of concrete structures, that overcome the disadvantages of existing practices.

SUMMARY OF THE INVENTION

Embodiments of the present invention, in their several aspects, provide methods and devices that facilitate the repair of concrete structures. These methods employ a unique hopper-type device for introducing a cement slurry to cavities defined by a barrier and the internal surface of a hole being repaired. Though aspects of the invention may be uniquely adapted to use for repairing somewhat vertical surfaces, for example, bridge walls, piers, and abutments, aspects of the invention may be employed to repair any concrete surface, for example, wherever the filling of a cavity with a cement slurry is aided by gravity.

One embodiment of the invention is a method for repairing a hole in a surface, the method comprising or including: positioning a barrier, for example, a board, over a hole in a surface, for example, a hole in the surface of a concrete wall, wherein a portion of the hole is not covered by the barrier and wherein the barrier and the hole define a cavity; mounting a hopper having an open top, sides, and a discharge outlet on to the surface where the discharge outlet is positioned over the portion of the hole not covered by the barrier; pouring a cement slurry into the open top of the hopper wherein the cement slurry flows through the hopper, out the discharge outlet, into the portion of the hole not covered by the barrier, and into the cavity to substantially completely fill the cavity with cement slurry; allowing the cement slurry in the cavity to at least partially harden; and removing the hopper and barrier from the surface to reveal a repaired hole in the surface. In one aspect, the method further comprises inserting an isolation plate, or gate plate, between the portion of the hole not covered by the barrier and the discharge outlet of the of the hopper.

In one aspect, the allowing the cement slurry in the cavity to at least partially harden comprises allowing the cement slurry in the cavity to at substantially completely harden.

In one aspect, the barrier may be a board, a plate, or a panel. In one aspect, positioning the barrier over the hole is practiced by mounting the barrier to the surface, for example, with a plurality of mechanical fasteners.

In one aspect, the uncovered portion of the hole is positioned adjacent a top of the hole. In one aspect, pouring cement slurry into the open top of the hopper is practiced with a plurality of pours. In one aspect, inserting the isolation plate is practiced by sliding the isolation plate within opposing recesses in the hopper.

In one aspect, pouring the cement slurry into the open top of the hopper may be practiced by pouring the cement slurry into a cement funnel and into the open top of the hopper. In one aspect, pouring the cement slurry into the funnel and into the open top of the hopper may be practiced by passing the cement slurry from an open top of the funnel and out of a bottom outlet of the funnel.

Another embodiment of the invention is a cement slurry hopper comprising or including: a rear wall; opposing sidewalls mounted to the rear wall; an open top sized and shaped to receive a cement slurry; an open front adapted to contact a surface being repaired; and a slanted bottom sized and shaped to convey the cement slurry received by the open top to a cavity in the surface being repaired. In one aspect, the hopper further includes opposing mounting flanges mounted to the opposing sidewalls. In another aspect, the hopper further includes opposing spacer bars adapted to be positioned on the opposing mounting flanges. In one aspect, the opposing spacer bars may be mounted to the opposing mounting flanges.

In one aspect, the slanted bottom may have a slant angle $\theta$ from 30 degrees to 60 degrees. In another aspect, the opposing sidewalls comprise a slant angle $\alpha$ from 30 degrees to 60 degrees.

A further embodiment of the invention is a cement slurry hopper assembly comprising or including: the cement slurry hopper recited described herein; and an isolation plate, or steel gate plate, adapted to at least partially cover the open front of the cement slurry hopper. In one aspect, the cement slurry hopper of the assembly further includes opposing mounting flanges mounted to the opposing side walls, and opposing spacer bars adapted to be positioned on the opposing mounting flanges. In one aspect, the isolation plate may be adapted to be received by opposing recesses defined by the opposing spacer bars.

A further embodiment of the invention is a cement slurry handling assembly comprising or including: the cement slurry hopper disclosed herein; and a cement slurry funnel having an open top adapted to receive a cement slurry and a bottom outlet in fluid communication with the open top of the cement slurry hopper. In one aspect, the cement slurry funnel comprises an enclosure having two opposing sides and a slanted side between the two opposing sides. The two opposing sides and the slanted side form the open top and the bottom outlet. The slanted side may be shaped and positioned to guide the cement slurry to the bottom outlet.

In one aspect, the cement slurry funnel further comprises at least two opposing projections, each of the at least two opposing projections extending from a bottom of one of the opposing slides. The at least two opposing projections may be positioned and adapted to engage the open top of the cement slurry hopper. In one aspect, the assembly may further include an isolation plate adapted to at least partially cover the open front of the cement slurry hopper.

Another embodiment of the invention is a cement slurry funnel comprising or including: an enclosure having two opposing sides and a slanted side between the two opposing sides, the two opposing sides and the slanted side forming an open top adapted to receive a cement slurry and a bottom outlet, the slanted side shaped and positioned to guide the cement slurry to the bottom outlet; and at least two opposing projections, each of the at least two opposing projections extending from a bottom of one of the opposing slides, the at least two opposing projections positioned and adapted to engage an open top of a cement slurry hopper. In one aspect, each of the at least two opposing projections comprises an extension from the bottom of one of the opposing vertical sides. In another aspect, the funnel may further include a projection from a bottom of the slanted side positioned and adapted to engage the open top of the cement slurry hopper. In one aspect, the slanted side of the funnel may define a slant angle R ranging from 30 degrees to 60 degrees, for example, 45 degrees.

These and other aspects, features, and advantages of this invention will become apparent from the following detailed description of the various aspects of the invention taken in conjunction with the accompanying drawings.

BRIEF DESCRIPTION OF THE DRAWINGS

The subject matter, which is regarded as the invention, is particularly pointed out and distinctly claimed in the claims that appear at the end of this specification. The foregoing and other objects, features, and advantages of the invention will be readily understood from the following detailed description of aspects of the invention taken in conjunction with the accompanying drawings in which:

FIG. 17 is a left-side elevation view of isolation gate shown in FIG. 15, the right-side elevation view being a mirror image thereof.

FIG. 18 is a top plan view of the isolation plate shown in FIG. 15.

DETAILED DESCRIPTION OF THE INVENTION

Aspects of the present invention provide methods and devices for repairing walls, for example, concrete walls, having undesirable holes or imperfections, using a hardenable binder slurry, for example, a cement slurry. As used herein, a cement slurry may typically comprise a flowable binder, such as, cement. For example, the cement slurry may be a mixture of a cement binder and a liquid, typically, water, with or without the presence of an aggregate, such as, sand or gravel.

As known in the art, and according to aspects of the invention, the cement slurry "sets" or "hardens" into solid concrete. One cement that may typically be used for aspects of the invention may be a slurry of a hydraulic cement, such as, a Portland cement, as known in the art. However, aspects of the invention may be used with any flowable binding material, for example, a mortar, a grout, a plaster, or an asphalt. Though in the following disclosure a "cement slurry" may be used to refer to the flowable binding material associated with aspects of the invention, any flowable binder may be used with any aspect of the invention. In one aspect, the cement slurry may comprise a Class D concrete, or any other concrete slurry having relatively small stones, for example, less than 2-inch stones.

Figure 1:
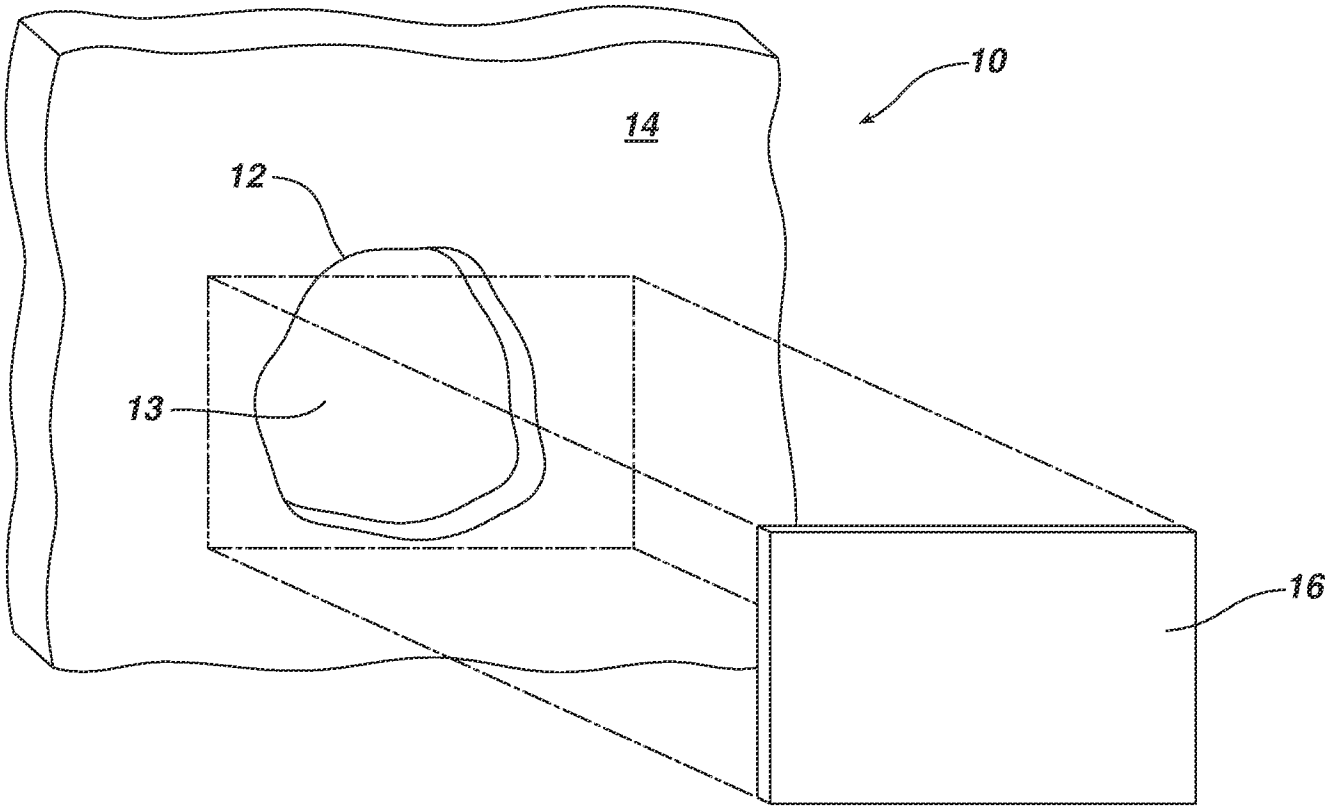
FIG. 1 is a schematic perspective view of a portion of a typical wall having a cavity or hole that may be repaired by employing an aspect of the invention.

FIG. 1 is a schematic perspective view of a portion of a typical wall 10, for example, a cement wall or a cinder block wall, having a defect or hole 12, that may be repaired by employing an aspect of the present invention. As is typical of such holes 12, hole 12 may have a bottom having a surface 13, for example, an inner, somewhat concave surface of varying depth. As shown in FIG. 1, the wall 10 typically includes an external surface 14 and the defect or hole 12 is located in external surface 14. As shown in FIG. 1, the surface 14 may typically be a vertical surface, for example, a surface substantially parallel with a plumb line positioned adjacent surface 14. However, it is envisioned that in some aspects, surface 14 may not be a truly vertical, or "plumb" surface, but surface 14 may be somewhat skewed from being truly vertical and aspects of the invention may still be used to repair surface 14. For example, as will be more apparent with the disclosure of the invention, surface 14 may lie in a plane ranging from plus or minus 90 degrees from truly vertical, or plus or minus 45 degrees from truly vertical, or plus or minus 30 degrees from truly vertical, but is typically substantially vertical, for example, plus or minus 5 degrees from truly vertical.

In one aspect, the methods and devices of the present invention may be used to repair any surface 14 for which the force of gravity aids the flow of the cement slurry. In another aspect, the methods and devices of the present invention may be used to repair any surface 14 for which the flow of the cement slurry can be aided or provided by a pressurized flow of cement slurry.

As used herein, defect or hole 12 may be any undesirable cavity or depression in the surface 14 of the wall 10. For example, in one aspect, hole 12 may be cavity formed in wall 10 due to the failure of an existing concrete structure or surface, for example, due to age, to wear, or to excessive loading, for example, impact by a vehicle or other structure. In another aspect, hole 12 may comprise a depression or cavity that was previously intentionally provided, but now requires to be filled or repaired, that is, for aesthetic or structural reasons.

As is typical in the art, the hole 12 may typically be cleaned to remove any loose material and wetted to provide a surface more conducive to applying a concrete slurry.

FIG. 1 also illustrates a barrier 16 that may typically be positioned over the hole 12 in the surface 14 prior to being positioned on wall 10.

Figure 2:
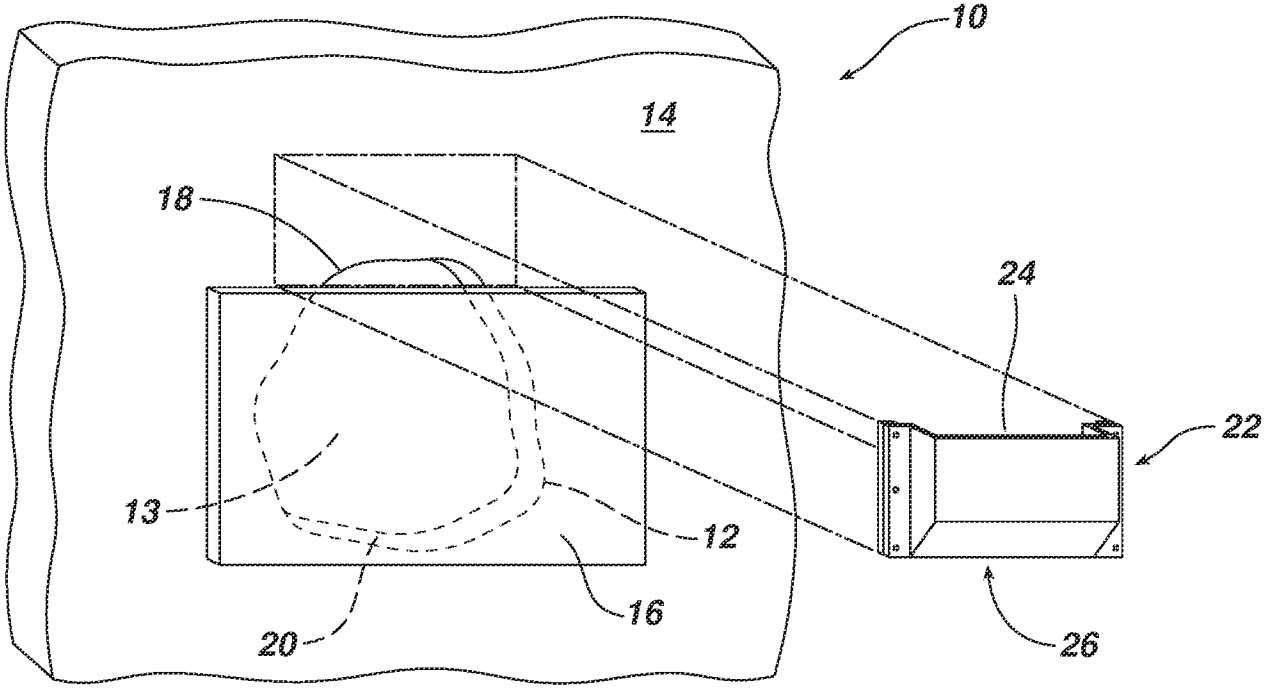
FIG. 2 is a schematic perspective view of the positioning of the barrier shown in FIG. 1 onto the surface of the wall and over the hole shown in FIG. 1 according to an aspect of the invention.

FIG. 2 is a schematic perspective view of the positioning of the barrier 16 shown in FIG. 1, for example, a piece of plywood, onto the surface 14 of wall 10 and over the hole 12 shown in FIG. 1 according to an aspect of the invention. As shown in FIG. 2, according to aspects of the invention, barrier 16 can be positioned over the hole 12 on the surface 14 wherein a portion 18 of the hole 12 is not covered by the barrier 16. That is, when barrier 16 is mounted over the hole 12 at least a portion 18 of hole 12 is left uncovered by barrier 16 and exposed and/or accessible. In addition, when barrier 16 is mounted over hole 12, hole 12 and the barrier 18 define a cavity 20 behind barrier 18. For example, cavity 20 may typically be formed by a portion of the inner surface of barrier 18 and a portion of the inner surface 13 of the hole 12. In one aspect, barrier 16 may be metallic, for example, a steel plate; wooden, for example, plywood; a plastic, such as, polyvinylchloride (PVC) board or polycarbonate board; or a composite, such as, gypsum board (that is, "sheet rock") or concrete board (for example, Durock brand cement board or Wonderboard brand cement board). Though identified in phantom in FIG. 2, the cavity 20 behind barrier 18 is more clearly shown in FIGS. 5 though 9. Barrier 16 may be mounted to the surface of 14 of wall 10 by conventional means, for example, with mechanical fasteners, such as, wire nails or concrete screws, for instance, Tapcon brand concrete screws, or their equivalent.

According to aspects of the invention, once barrier 16 is mounted over hole 12, a cement slurry hopper 22, for example, a specially-designed hopper 22, is mounted to the wall 10 and over the exposed portion 18 of hole 12. Hopper 22 may be mounted to wall 10 by conventional means, for example, with a plurality of mechanical fasteners, such as, lag screws, wire nails, or concrete screws. According to aspects of the invention, cement slurry hopper 22 typically includes an open top 24, sides, and a discharge outlet 26 where the discharge outlet 26 is positioned over the portion 18 of the hole 12 not covered by the barrier 16. The detailed features of one hopper that may be used according to one aspect of the invention is shown and described with respect to FIGS. 10 through 14 below.

Figure 3:
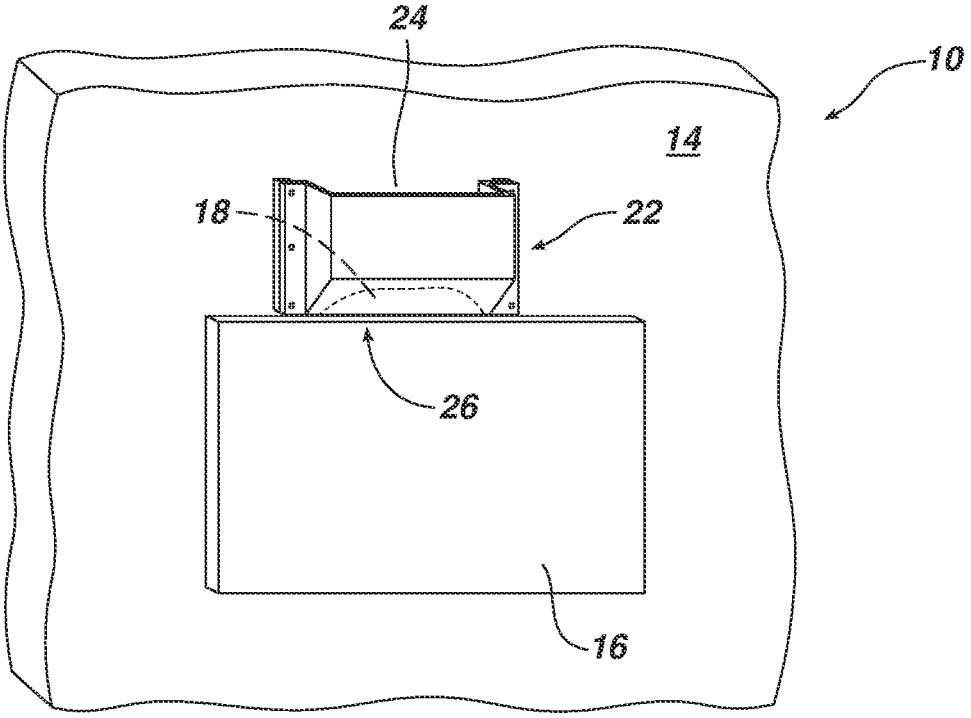
FIG. 3 is a schematic perspective view of the mounting of a cement slurry hopper onto the wall shown in FIG. 2 according to an aspect of the invention.

FIG. 3 is a schematic perspective view of the mounting of cement slurry hopper 22 onto the wall 10 shown in FIG. 2 according to an aspect of the invention. Though in the aspect of the invention shown in FIG. 3 hopper 22 is shown mounted only to the surface 14 of wall 10, it is envisioned that hopper 22 may also be at least partially mounted to barrier 16.

Figure 4:
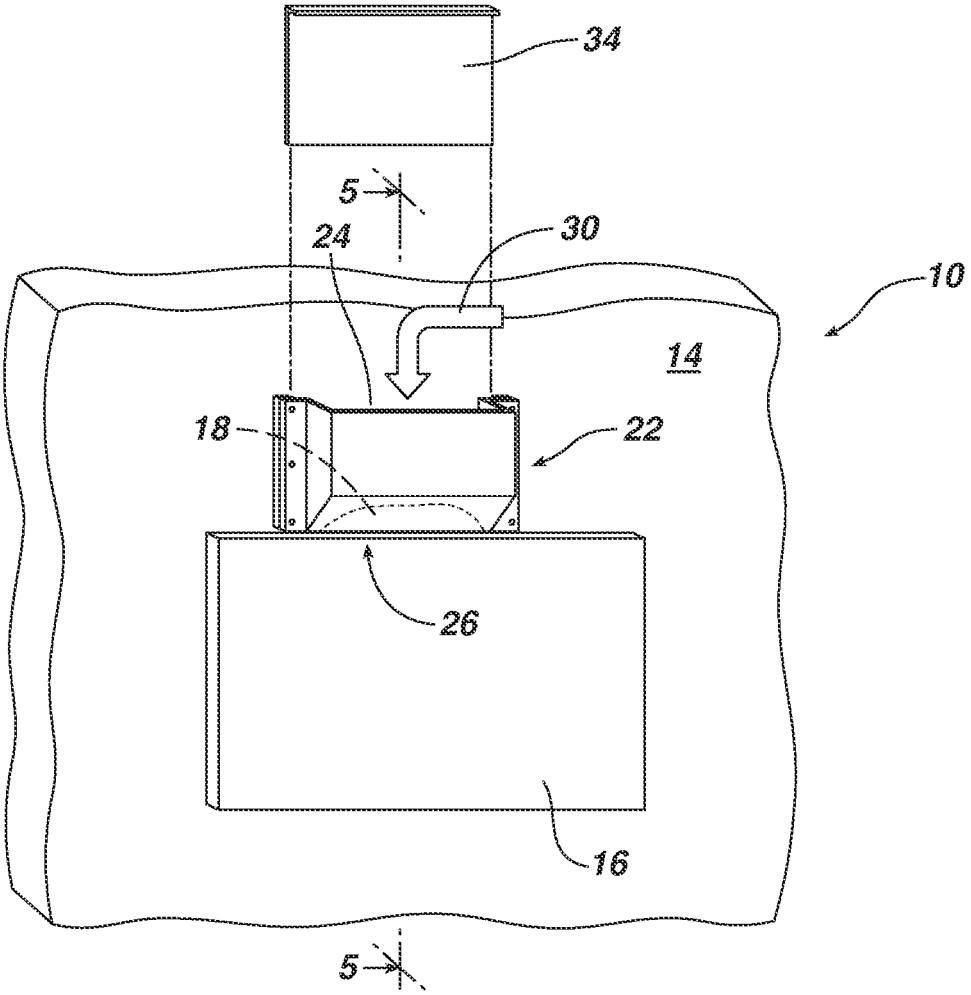
FIG. 4 is a schematic perspective view of the cement slurry hopper on the wall shown in FIG. 3 and the introduction of a cement slurry into the hopper according to an aspect of the invention.

FIG. 4 is a schematic perspective view of the cement slurry hopper 22 on the wall 10 shown in FIG. 3 and the introduction of a cement slurry 30 into hopper 22 according to an aspect of the invention. As shown in FIG. 4, once the hopper 22 is mounted to wall 10 as shown in FIG. 3, a cement slurry 30, for example, with or without aggrege, is then introduced, for example, poured, into the open top 24 of the hopper 22. Based upon the design of hopper 22, when introduced to the open top 24, the cement slurry 30 flows through the hopper 22, out the discharge outlet 26, into the portion 18 of the hole 12 not covered by the barrier 16, and into the cavity 20. The flow of cement slurry 30 may typically be due to the weight of the cement slurry 30 and the force of gravity, for example, only due to the force of gravity; however, in one aspect, the cement slurry 30 may be introduced to the open top 24 of hopper 22 under pressure, for example, from a pressurized source of cement slurry, such as, using a concrete pump or a grout pump, and may flow through hopper 22 and into cavity 20 under pressure.

FIG. 4 also illustrates an isolation plate 34 that may be inserted between the cement slurry 30 in cavity 20 and the cement slurry 30 in hopper 22 to isolate these slurries according to an aspect of the invention. Further disclosure of this isolation plate 34 and its function is provided with respect to FIG. 7 and its description.

Figure 5:
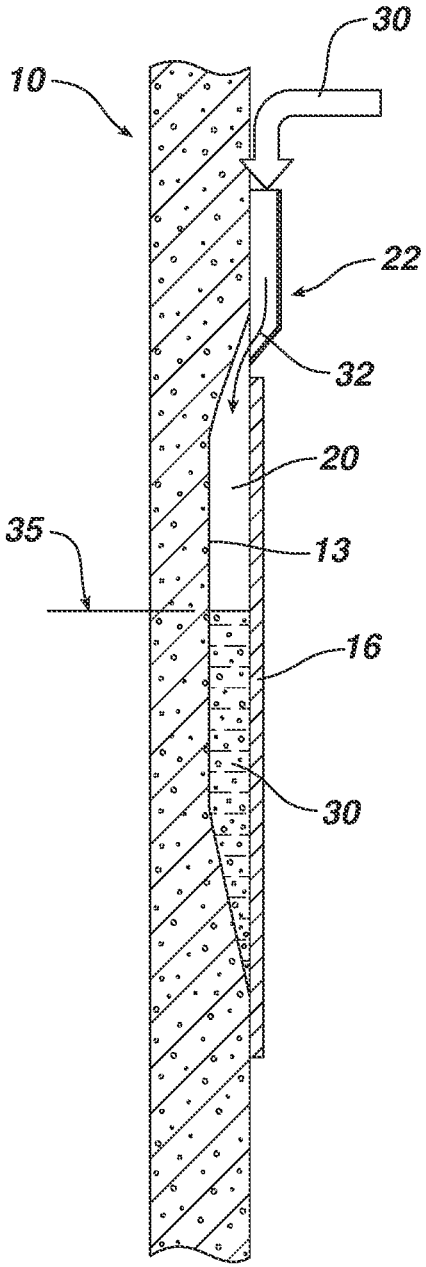
FIGS. 5 through 9 are cross-sectional elevation views of the assembly of the cement slurry hopper, the barrier, and the wall shown in FIG. 4 as viewed along section lines 5-5 in FIG. 4 illustrating a sequential repair of the wall according to an aspect of the invention.

FIGS. 5 through 9 are cross-sectional elevation views of the assembly of the cement slurry hopper 22, the barrier 16, and the wall 10 shown in FIG. 4 as viewed along section lines 5-5 in FIG. 4 illustrating the sequential repair of the wall 10 according to an aspect of the invention. As shown in FIG. 5, with the introduction of the cement slurry 30 into the hopper 22, the cement slurry 30 flows through hopper 22 and out the hopper discharge outlet 26, as indicated by arrow 32, and into cavity 20 behind barrier 16. As shown in FIG. 5, the filling of cavity 20 with cement slurry 30 may be practiced in multiple pours to one or more levels 35; however, in other aspects, the filing of cavity 20 may be practiced substantially continuously.

Figure 6:
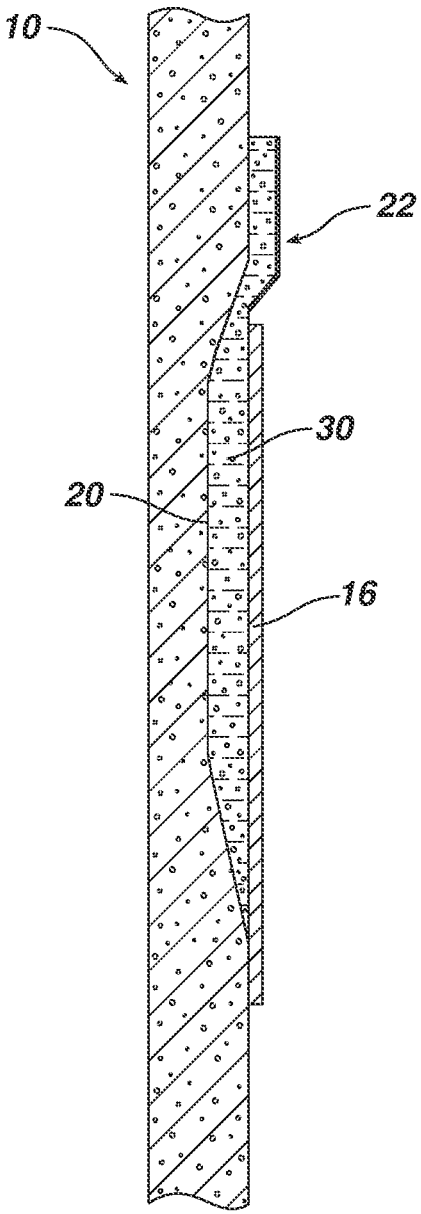

FIG. 6 is a cross sectional view similar to FIG. 5 where the cement slurry 30 substantially completely fills the cavity 20. As shown, in FIG. 6, with the substantial complete filling of cavity 20 with cement slurry 30, at least some of the hopper 22 may also be filled with cement slurry 30. However, typically, with the substantially complete filling of cavity 20 with cement slurry 30, the hopper 22 may also be substantially completely filled with cement slurry 30.

In one aspect, after the substantially complete filling of cavity 20 with cement slurry 30, some form of impact may be applied to the outer surface of barrier 16 to promote settling of the cement slurry 30, for example, into any crevices or voids that may not have filled with cement slurry 30. This promotion of settling of the mortar 30 may be practiced with a one or more hammer strikes upon barrier 16, with contact of barrier 16 with a vibrating device, and/or the insertion of a vibrating device into the cement slurry 30 in cavity 20.

Figure 9:
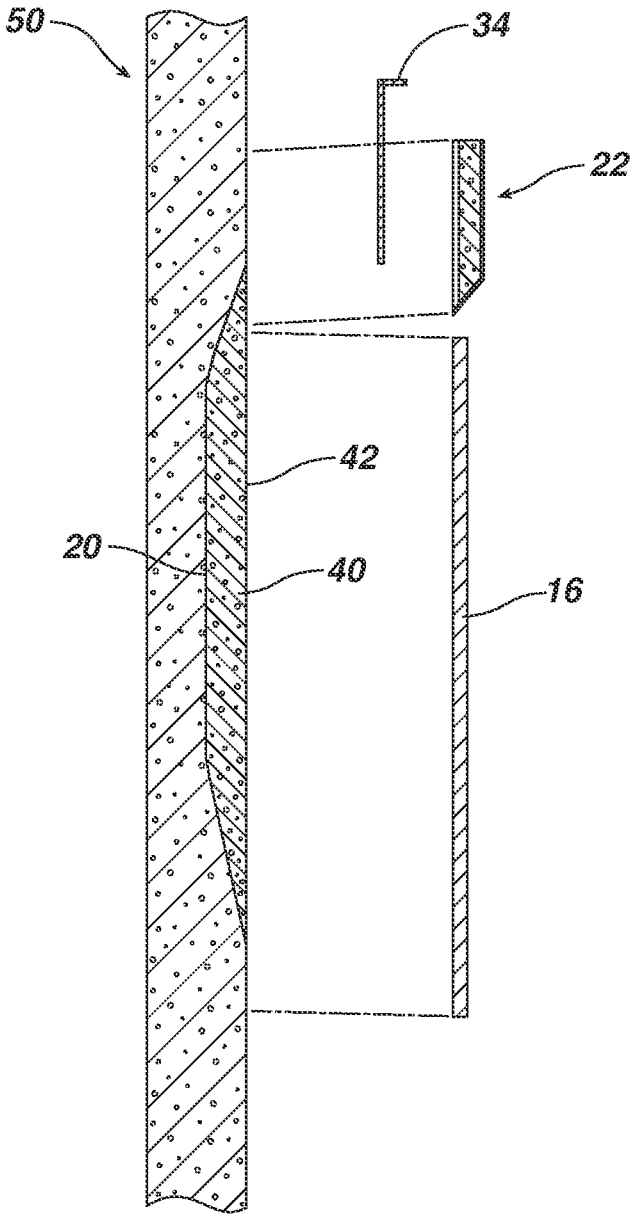

In one aspect of the invention, after substantially completely filing the cavity 20 with cement slurry 30 as shown in FIG. 6, the cement slurry 30 may be allowed to cure, set, or harden, for example, for at least 2 hours, but typically between 2 and 10 hours. However, as understood in the art, the set time may vary depending, among other things, upon the temperature of the cement slurry introduced. Then, after the cement slurry 30 behind barrier 16 is sufficiently set, the hopper 22 and barrier 16 may be removed from wall 10 to reveal the hardened cement slurry 40 in filled cavity 20, for example as shown in FIG. 9. In one aspect, the removal of hopper 22 and barrier 16 may provide a finished repaired wall 50 requiring little or no further treatment or touchup. However, it is envisioned that, after the removal of hopper 22 and barrier 16, repaired wall 50 may require at least some finish work, for example, filling of unfilled voids with cement slurry 30 and/or removal of excess hardened cement slurry 40, to provide the desired appearance and/or surface finish.

Figure 7:
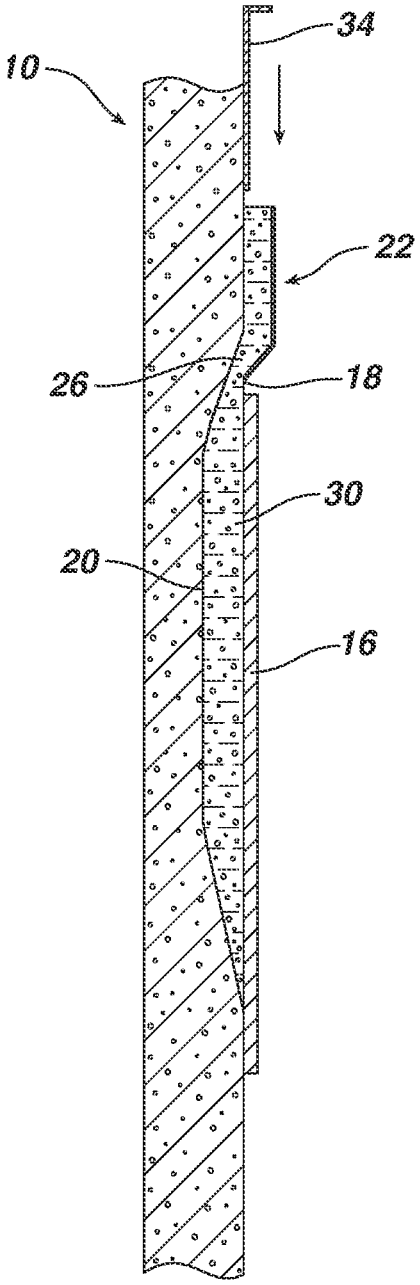

However, in another aspect of the invention, after substantially completely filing the cavity 20 with cement slurry 30 as shown in FIG. 6, an isolation plate or "gate" 34 may be used to isolate the cement slurry 30 in hopper 22 from the cement slurry 30 in cavity 20, for example, to minimize or prevent the cement slurry 30 in the hopper 22 to harden into the cement slurry 30 in cavity 20. FIG. 7 illustrates one method for isolating the cement slurry 30 in cavity 20 from the cement slurry 30 in hopper 22 according to one aspect of the invention.

FIG. 7 is a cross sectional view similar to FIG. 6 illustrating the insertion of the isolation plate 34 according to one aspect of the invention. As shown in FIG. 7, in one aspect, after filling cavity 20 with cement slurry 30 and at lease partially filling hopper 22 with cement slurry 30, the isolation plate 34 may be inserted between the cement slurry 30 in cavity 20 and the cement slurry 30 in hopper 22. According to one aspect, isolation plate 34 may be inserted between the portion 18 of the hole 12 or cavity 20 that is not covered by barrier 16 and the discharge outlet 26 of the hopper 20. In another aspect, isolation plate 34 may be inserted between the portion 18 that is not covered by barrier 16 and the portion of the surface 14 of wall 18 opposite the open side of hopper 22. In one aspect, any plate or panel may be used as isolation plate 34, for example, isolation plate 34 may be made of metal, wood, or plastic. However, in one aspect, isolation plate 34 is metallic, for example, made from a steel, for instance, a grade A36 steel, or its equivalent. In one aspect, isolation plate 34 may be uniquely designed to engage with hopper 22, for example, the isolation plate 34 may be sized and shaped to engage with hopper 22. One isolation plate 34 that may be used for one aspect of the invention is shown and described with respect to FIGS. 15 through 18.

Since the insertion of isolation plate 34 may be obstructed by the presence of uncured cement slurry 30, for example, uncured cement slurry in hopper 22, the insertion of isolation plate 34 may require exertion or effort by the mechanic. For example, in one aspect, isolation plate 34 may be inserted with the impact from a hammer or by a powered device, such as, a pneumatic impactor, such as, a pneumatic hammer or a "jackhammer."

According to aspects of the invention, after cavity 20 is filled with cement slurry 30 and hopper 22 is at least partially filled with cement slurry 30 (the hopper 22 may typically be substantially completely filled with cement slurry 30), with or without the insertion of isolation plate 34, the cement slurry 30 in at least cavity 20 is allowed to harden, cure, or "set." The cure time of cement slurry 30 may vary depending upon the size of cavity 20, the type of cement slurry 30, the temperature of the cement slurry 30, and the ambient temperature, among other things. However, typically, the cure time of cement slurry 30 may range from 2 hours to 10 hours, but is typically ranges from 2 hours to 6 hours.

Figure 8:
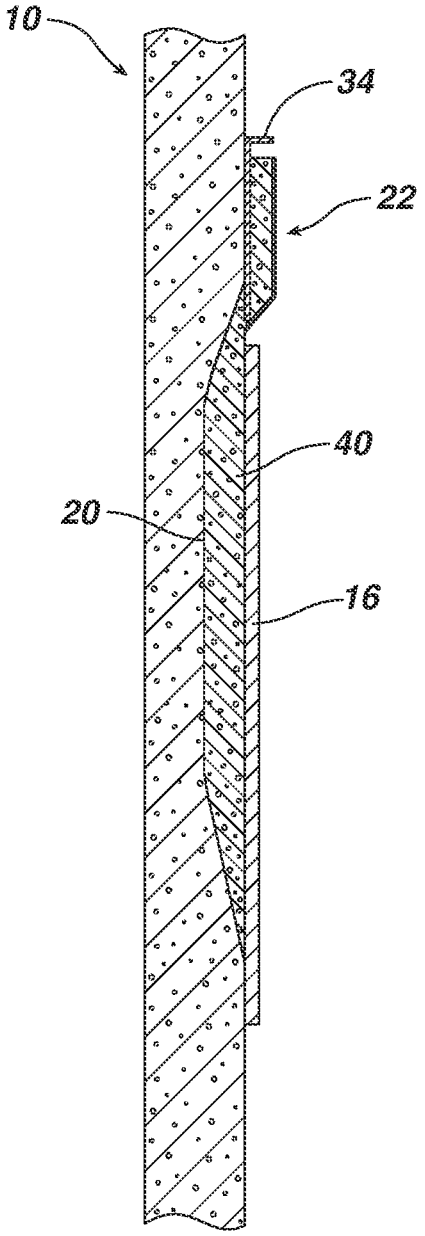

Upon completion of sufficient curing, cement slurry 30 in cavity 20 becomes cured or hardened cement 40 in cavity 20 as indicated in FIG. 8. FIG. 8 is a cross sectional view similar to FIG. 7 illustrating the assembly of the hopper 22 and barrier 16 on wall 10 after the curing of cement slurry 30 to hardened cement 40. With completion of the cure of cement 40, hopper 22, isolation plate 34, and barrier 16 may be removed from wall 10 as shown in FIG. 9.

FIG. 9 is a cross sectional view similar to FIG. 8 illustrating the removal of hopper 22, with or without isolation plate 34, and barrier 16 from repaired wall 50 after the curing. As shown in FIG. 9, removal of the hopper 22, isolation plate 34, and barrier 16 reveals a repaired cavity 20 in repaired wall **5*o* having a surface 42 of hardened cement 40 in cavity 20. In one aspect, upon removal of hopper 22 and barrier 16, a substantially finished surface 42 may be provided. However, it is envisioned that, after the removal of hopper 22 and barrier 16, repaired wall 5*o* having surface 42 may require at least some finish work, for example, the filling of unfilled voids with cement slurry 30 and/or the removal of excess hardened cement 40** to provide the desired appearance and/or surface finish.

Figure 10:
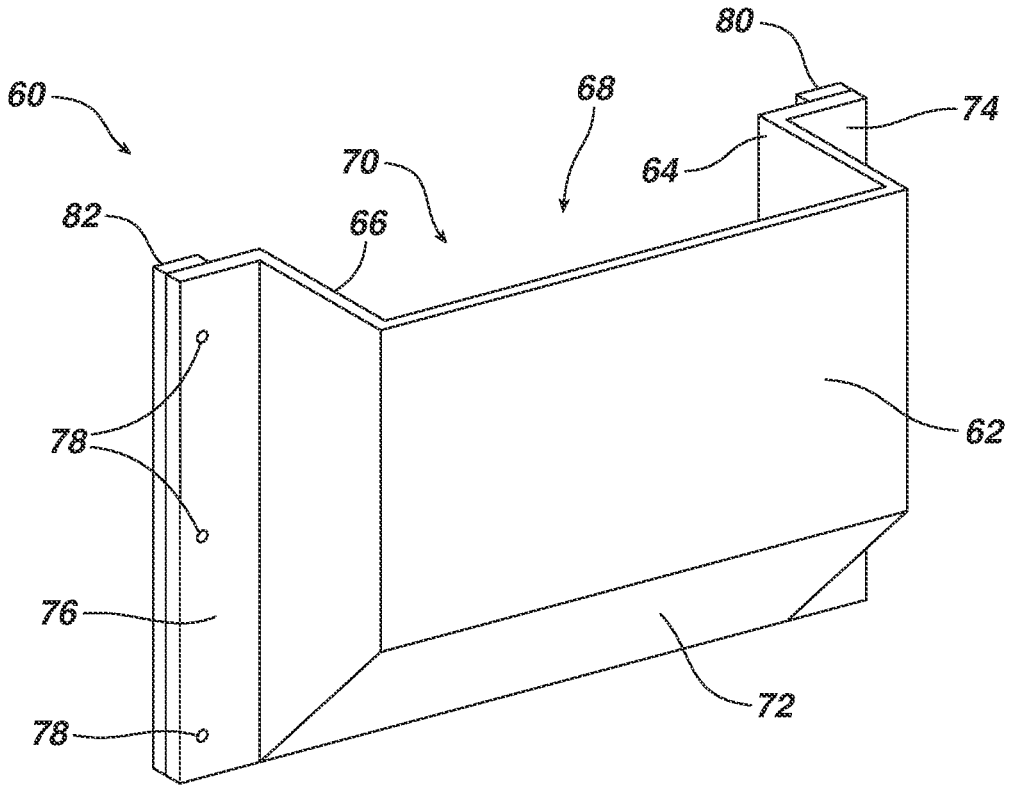
FIG. 10 is a perspective view of one cement slurry hopper that may be used for the hopper shown in FIGS. 2 through 9 according to one aspect of the invention.
Figure 11:
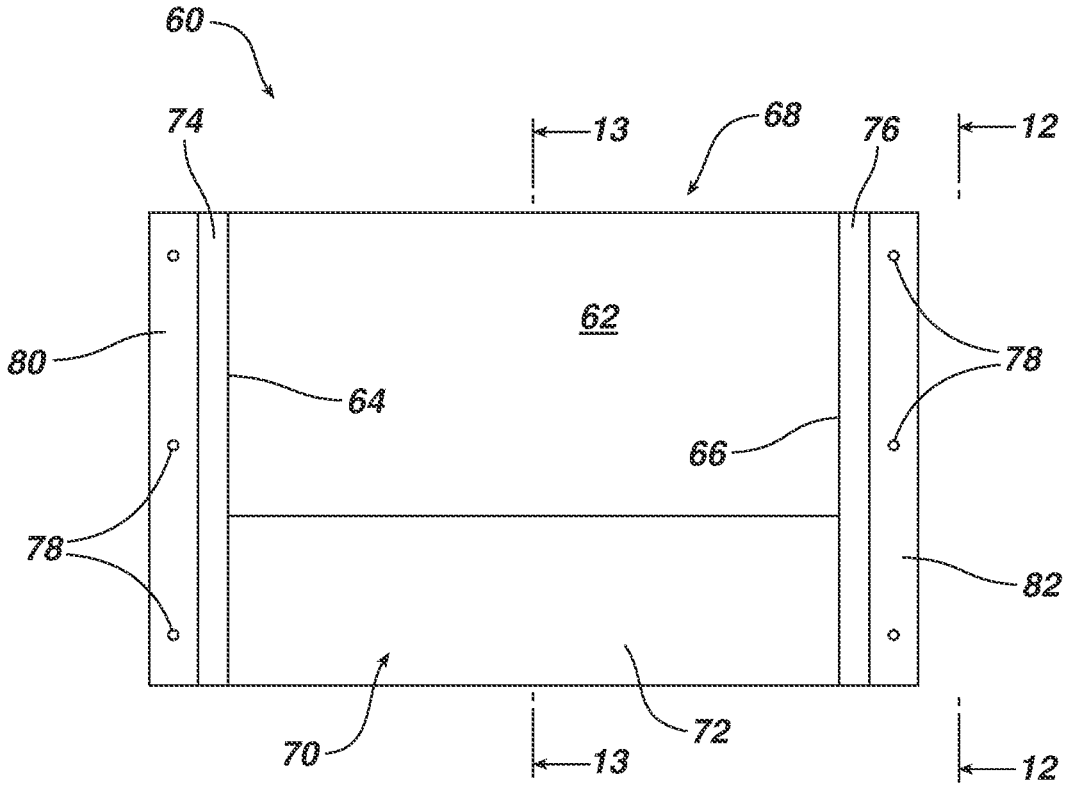
FIG. 11 is a front elevation view of the cement slurry hopper shown in FIG. 10.
Figure 12:
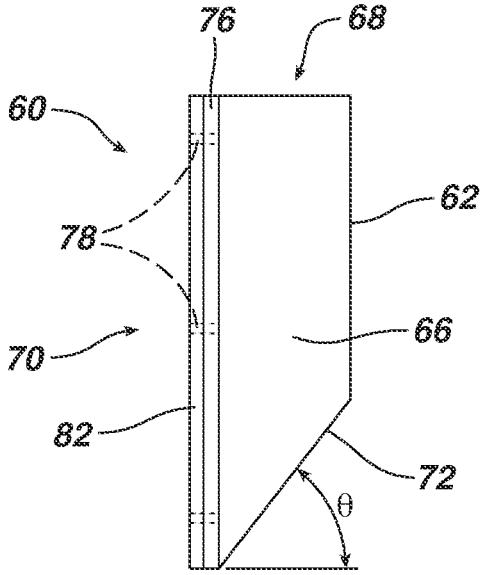
FIG. 12 is side elevation view of the cement slurry hopper shown in FIG. 11 as viewed along view lines 12-12 in FIG. 11.
Figure 13:
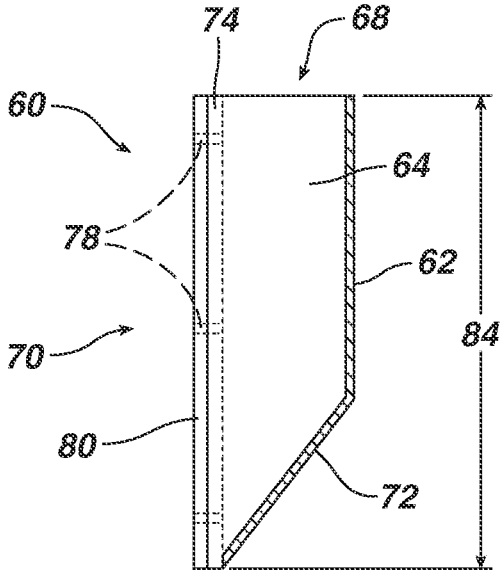
FIG. 13 is cross-sectional elevation view of the cement slurry hopper shown in FIG. 11 as viewed along section lines 13-13 in FIG. 11.
Figure 14:
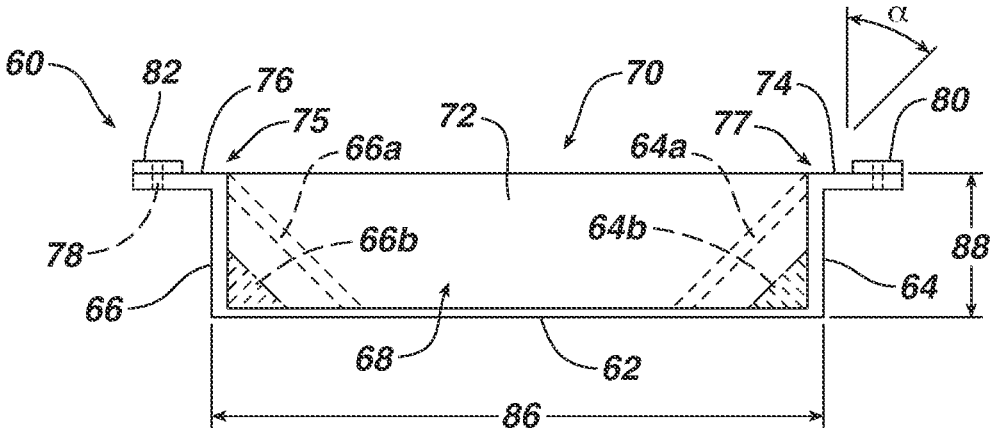
FIG. 14 is a top plan view of the cement slurry hopper shown in FIG. 10.

FIG. 10 is a perspective view of a cement slurry hopper 60 that may be used for hopper 22 shown in FIGS. 2 through 9 according to one aspect of the invention. FIG. 11 is a front elevation view of hopper 60 shown in FIG. 10. FIG. 12 is side elevation view of hopper 60 shown in FIG. 11 as viewed along view lines 12-12 in FIG. 11. FIG. 13 is cross-sectional elevation view of hopper 60 shown in FIG. 11 as viewed along section lines 13-13 in FIG. 11. FIG. 14 is a top plan view of hopper 60 shown in FIG. 10.

As shown in FIGS. 10 through 14, cement slurry hopper 60 includes a rear wall 62, opposing sidewalls 64 and 66 mounted to the rear wall 62, an open top 68 sized and shaped to receive a cement slurry (for example, as shown in FIG. 4), an open front 70 adapted to contact a surface being repaired (for example, wall 10 shown in FIGS. 1 through 5); and a slanted bottom 72 sized and shaped to convey the cement slurry received by the open top 68 to a cavity in the surface being repaired (for example, cavity 20 in wall 10 shown in FIGS. 1 through 5). As disclosed herein, hopper 60 may be uniquely adapted to mount to the surface of wall having a cavity under repair, that is, where, when mounted, the opposing sides 64, 66 contact the wall; the open top 68 receives a cement slurry; and with the slanted bottom 72 directs the cement slurry to the cavity in the wall being repaired.

As shown most clearly in FIG. 14, in one aspect, open front 70 may be flanked by opposing mounting flanges 74 and 76 mounted to sidewalls 64 and 66, respectively. Mounting flanges 74 and 76 may include one or more mounting holes 78, for example, through holes, which may typically be used with fasteners to mount hopper 60 to a surface being repaired. Mounting flanges 74 and 76 may be between about ¼ inch and about W inch think, for instance, ⅜ inch thick. In one aspect, when flanges 74 and 76 are provided, flanges 74 and 76 and sidewalls 64 and 66 may be provided by L-shaped structural members, for example, an L-shaped 2-inch×3-inch×⅜ inch (L2×3×⅜") structural member.

In one aspect, hopper 60 may include spacer bars 80 and 82. Spacer bars 80 and 82 may be mounted to mounting flanges 74 and 76, for example, when using hopper 60 with an isolation gate, for example, isolation plate 90 shown in FIGS. 15 through 18. Though, in one aspect, spacer bars 8*o* and 82 may be provided, for example, welded to mounting flanges 74 and 76, to provide at least some spacing between the open front 70 and the surface to which hopper 60 is mounted, in other aspects, spacer bars 80 and 82 may be omitted. In one aspect, spacer bars 80 and 82 may be provided to define a slot between the open front 70 of hopper 66 and the surface to which hopper 60 is mounted that is adapted to receive an isolation plate. The slot between the open front 70 of hopper 66 and the surface to which hopper 60 is mounted may define opposing recesses 75 and 77 (see FIG. 14) into which the isolation plate may be inserted. As disclosed herein, an isolation plate, such as, isolation plate 90 shown in FIGS. 15 through 18, may be used to isolate the cement slurry in hopper 66 from the cement slurry in the cavity being repaired. Accordingly, in one aspect, the thickness of spacer bars 80 and 82 may be comparable to the thickness of the isolation plate used, for example, between about ⅛ inch and about W inch think, for instance, ¼ inch thick. As shown, spacer bars 80 and 82 may typically include mounting holes compatible with mounting holes 78 in flanges 74 and 76. Though, in one aspect, spacer bars 80 and 82 may be mounted to mounting flanges 74 and 76, for example, by welding, in another aspect, spacer bars 80 and 82 may not be mounted to mounting flanges 74 and 76, but may be separate, "loose" bars that may be positioned on mounting flanges 74 and 76 only when needed.

As shown in FIG. 12, the slanted bottom 72 may be fashioned with an slant angle θ, for example, with reference to a horizontal, for instance, to a plane substantially perpendicular to the surface of rear wall 62. Slant angle θ may range from 15 degrees to 75 degrees, but typically ranges from 30 degrees to 60 degrees, for example, about 52 degrees.

The dimensions of hopper 60 may vary due to, among other things, the size of the cavity being repaired and the consistency of the cement slurry being handled by hopper 60. According to aspects of the invention, hopper 60 may have a height 84 (see FIG. 13) from 3 inches to 36 inches, but typically has a height 84 from 6 inches to 12 inches, for example, 10 inches. Hopper 60 may have a width 86 (see FIG. 14) from 6 inch to 36 inches, but typically has a width 86 from 8 inches to 16 inches, for example, 12½ inches. Hopper 60 may have a depth 88 (see FIG. 14) from 1 inch to 12 inches, but typically has a depth 88 from 2 inches to 6 inches, for example, 3 inches.

In addition, the thicknesses of the components of hopper 60, for example, the thicknesses of rear wall 62, sidewalls 64 and 66, slanted bottom 72, flanges 74 and 76, may vary due to, among other things, the size of the cavity being repaired and the consistency of the mortar being used. However, in one aspect, the thicknesses of the components of hopper 60 may be from 1/16 inch to 1 inch, but typically having thicknesses from ⅛ inch to ⅜ inch, for example, ¼ inch.

Though in one aspect, the shape of hopper 60 may be substantially rectilinear, for example, as indicated by the rectangular shape of rear wall 62 and sidewalls 64 and 66 of hopper 60 shown in FIG. 14, hopper 60 may not be rectilinear. For example, in other aspects, the shape of hopper 60 may be circular, or elliptical, or polygonal, for example, as viewed in the top plan view of FIG. 14. In one aspect, rear wall 62 and sidewalls 64 and 66 may be rectilinear as shown, but rear wall 62 and sidewalls 64 and 66 may also be defined by a circular are, an elliptical are, or a polygonal arc. For example, in one aspect, the sidewalls 64 of 66 may not be substantially perpendicular to the rear wall 62, but may be slanted or beveled as shown in phantom by sidewalls 64*a* and 66*a* in FIG. 14. In one aspect, slanted sidewalls 64*a* and 66*a* may be oriented at a slant angle α between the plane of sidewalls 64*a* and 66*a* and a plane perpendicular to the plane defined by the surfaces of flanges 74 and 76. Slant angle α may range from 15 degrees to 75 degrees, but typically ranges from 30 degrees to 60 degrees, for example, about 45 degrees. In another aspect, the corners between sidewalls 64 of 66 and the rear wall 62 may be filled, or otherwise slanted or beveled, as shown in phantom by chamfers or bevels 64*b* and 66*b* in FIG. 14. Chamfers or bevels 64*b* and 66*b* may be provided by conventional means, for example, by welding, by an adhesive, such as, an epoxy, or formed in fabricating side walls 64 and 66. In one aspect, chamfers or bevels 64*b* and 66*b* may be oriented at the slant angle α, in a fashion similar to sidewalls 64*a* and 66*a*, between the plane of chamfers or bevels 64*b* and 66*b* and a plane perpendicular to the plane defined by the surfaces of flanges 74 and 76. Slant angle α for chamfers or bevels 64*b* and 66*b* may range from 15 degrees to 75 degrees, but typically ranges from 30 degrees to 60 degrees, for example, about 45 degrees. It is believed that providing slanted sidewalls 64*a* and 66*a* to hopper 60 may facilitate disengagement of hopper 60 from the hardened cement hopper 60 may contain according to aspects of the invention.

According to aspects of the invention, hopper 60 may be fabricated from any appropriate material, for example, depending, among other things, upon the size of hopper 60 and the size of hole being repaired. For example, hopper 6*o*, including rear wall 62, sidewalls 64 and 66, slanted bottom 72, flanges 74 and 76, and spacer bars 8*o* and 82, may be metallic, plastic, or wood. When metallic, hopper 60 may be made from any structural material, for example, steel, stainless steel, aluminum, or titanium. However, hooper 60 may typically be made of steel, for instance, grade A36 steel, or its equivalent. When made of steel, hopper 60 may be fabricated by welding of suitably sized metal plate.

Figure 15:
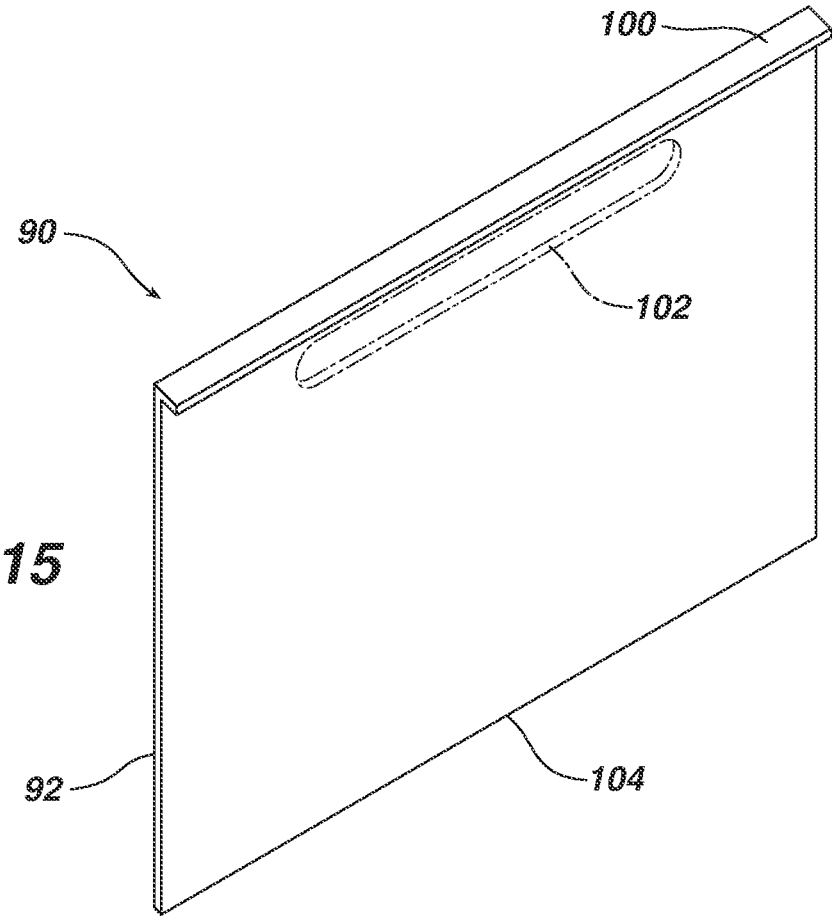
FIG. 15 is a perspective view of one isolation plate that may be used for the hopper gate shown in FIGS. 2 through 9 or with the cement slurry hopper shown in FIGS. 10 through 14 according to one aspect of the invention.
Figure 16:
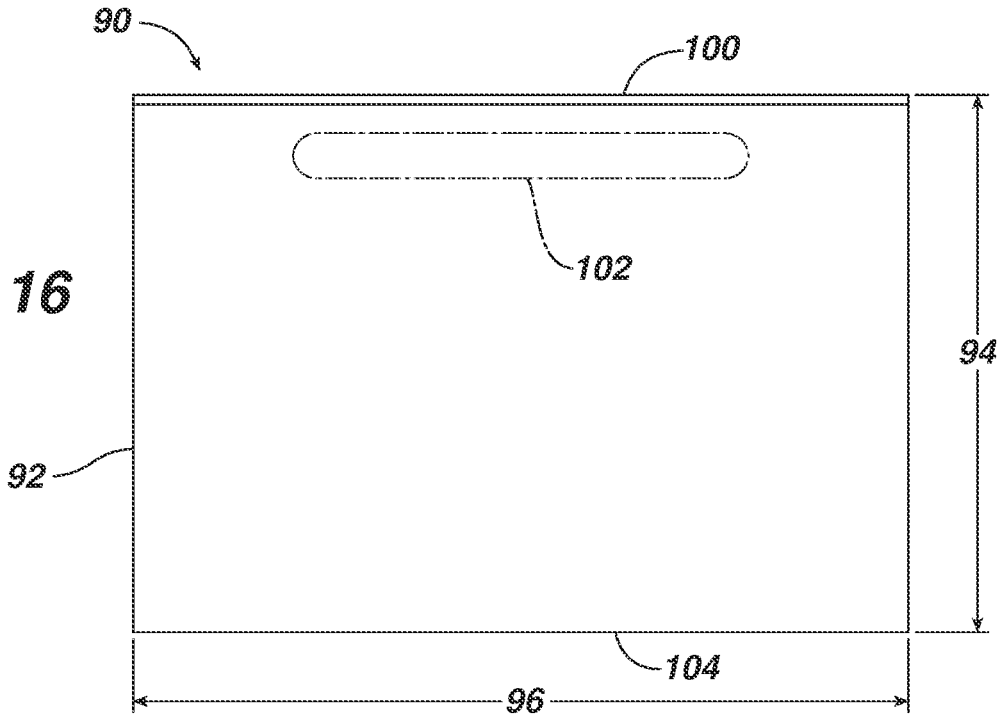
FIG. 16 is a front elevation view of the isolation plate shown in FIG. 15.

FIG. 15 is a perspective view of an isolation plate 90, or an isolation gate, that may be used for isolation plate 34 shown in FIGS. 4 through 9 or with cement slurry hopper 22 shown in FIGS. 10 through 14 according to one aspect of the invention. FIG. 16 is a front elevation view of isolation plate 90 shown in FIG. 15. FIG. 17 is a left-side elevation view of isolation gate 90 shown in FIG. 15, the right-side elevation view being a mirror image thereof. FIG. 18 is a top plan view of isolation plate gate 90 shown in FIG. 15.

As shown in FIGS. 15 through 18, isolation plate 90 may comprise a substantially flat plate 92, for example, a rectangular or a substantially square flat plate, having a height 94 (see FIG. 16), a width 96 (see FIG. 16), and a thickness 98 (see FIG. 17) adapted to be received by a hopper, such as, hopper 22 or hopper 60 disclosed herein. According to aspects of the invention, isolation plate 90 may be used with a hopper to isolate the concrete slurry in the hopper from the concrete slurry discharged by the hopper.

The dimensions of plate 92 may vary due to, among other things, the size of the cavity being repaired and the consistency of the cement slurry being used. According to aspects of the invention, height 94 may range from 3 inches to 36 inches, but typically ranges from 6 inches to 12 inches, for example, 9 W inches. Width 96 may range from 3 inches to 36 inches, but typically ranges from 10 inches to 18 inches, for example, 14 inches. Thickness 98 may range from 1/16 inch to 1 inch, but typically ranges from 1/8 inch to 1/4 inch, for example, 1/8 inch.

As shown in FIGS. 15 through 18, isolation plate 90 may include a flange or handle 100 mounted to plate 92, for example, to facilitate handling of isolation plate 90 and/or to provide a surface that can be impacted, for example, with a hammer, to assist in penetrating the concrete slurry with isolation plate 90. Upper flange 100 may have dimensions similar to plate 92 disclosed herein.

As also shown in FIGS. 15 through 18, isolation plate 90 may include one or more through holes 102 (shown in phantom) in plate 92, for example, to facilitate handling of isolation plate 90. However, in other aspects of the invention, through hole 102 may be omitted.

In one aspect, the lower edge 104 of plate 92 may be beveled or otherwise shaped to provide a taper or point along the width 96 to enhance the penetration of plate 90 through the concrete slurry.

According to aspects of the invention, isolation plate 90 may be fabricated from any appropriate material, for example, depending, among other things, upon the size of isolation plate 90 and the size of hole being repaired. For example, isolation plate 90, including plate 92 and flange 100, may be metallic, plastic, or wood. When metallic, isolation plate 90 may be made from any structural material, for example, steel, stainless steel, aluminum, or titanium. However, isolation plate 90 may typically be made of steel, for instance, grade A36 steel, or its equivalent. When made of steel, isolation plate 90 may be fabricated by welding, for example, welding flange 100 to plate 92.

Figure 20:
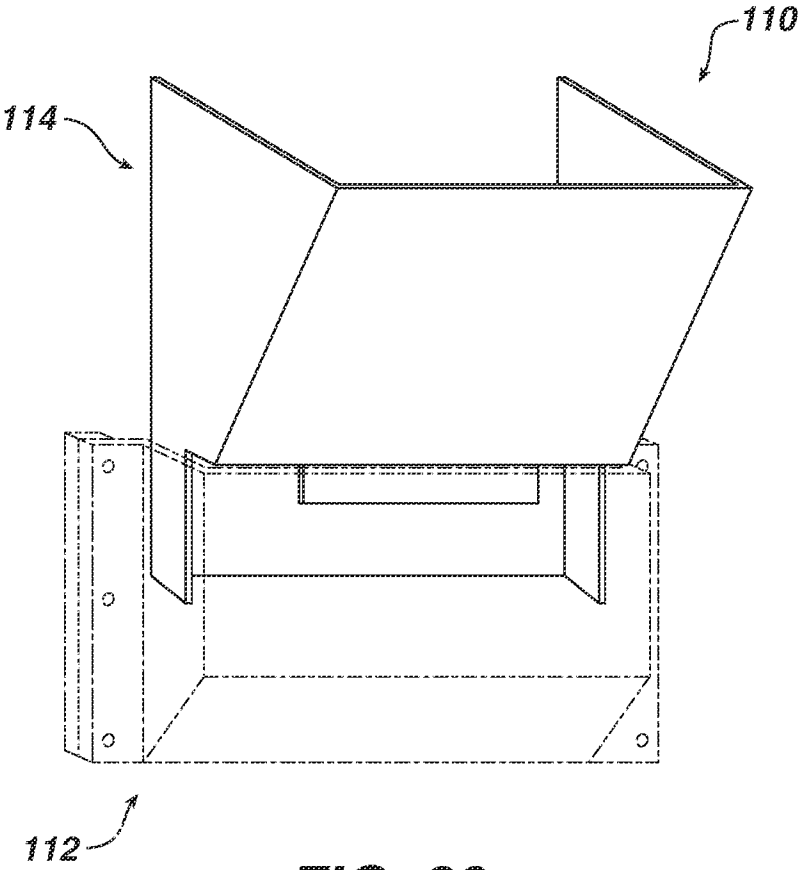
FIG. 20 is a detailed view of the cement slurry funnel shown in FIG. 19, with the cement slurry hopper shown in phantom, as identified by Detail 20 shown in FIG. 19.
Figure 19:
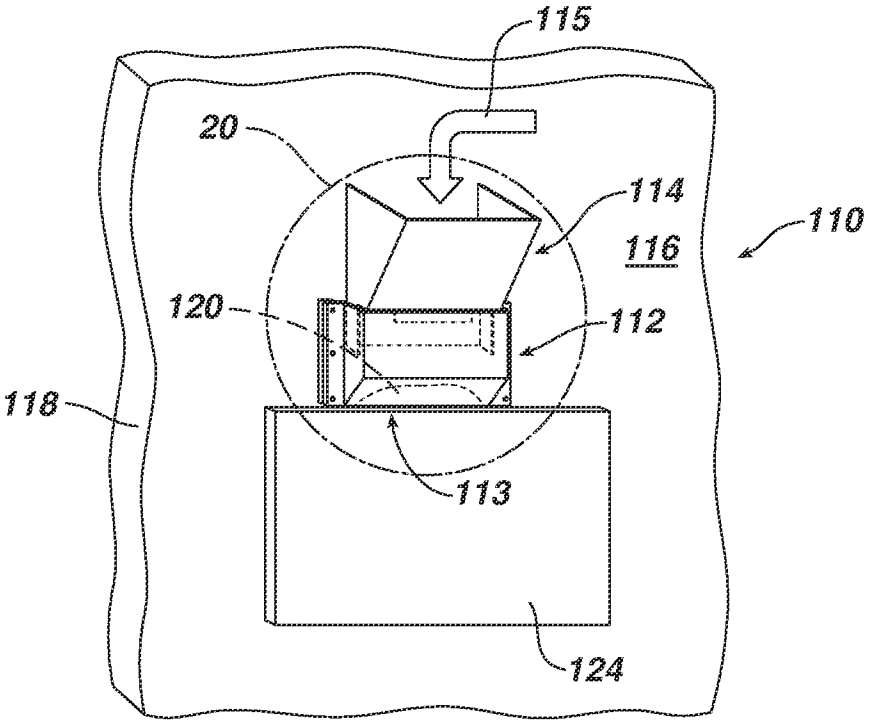
FIG. 19 is a schematic perspective view, similar to FIG. 3, of a cement slurry handling assembly having a cement slurry hopper and a cement slurry funnel according to an aspect of the invention.

FIG. 19 is a schematic perspective view, similar to FIG. 3, of a cement slurry handling assembly no having a cement slurry hopper 112 and a cement slurry funnel 114 according to another aspect of the invention. FIG. 20 is a detailed view of the cement slurry funnel 114 shown in FIG. 19, with the cement slurry hopper 112 shown in phantom, as identified by Detail 20 in FIG. 19. According to this aspect, cement slurry funnel 114 is provided to facilitate introducing a cement slurry 115 to the cement slurry hopper 112. Cement slurry hopper 112 may be similar, if not identical, to cement slurry hopper 22 or cement slurry hopper 60 disclosed herein, including having all the features and attributes of cement slurry hopper 22 or cement slurry hopper 60. In one aspect, cement slurry hopper 112 may also be accompanied by an isolation gate (not shown), for example, isolation gate 34 or isolation gate 90, as disclosed herein.

Though in one aspect, cement slurry funnel 114 may be uniquely adapted for use with a cement slurry hopper, it is envisioned that, in one aspect, cement slurry funnel 114 may be used or adapted for use with any application where a material is being handled, including any slurries, such as, cement slurries, or any particulate materials, such as, sand, gravel, asphalt, grain, wood chips, or candy corn, and introduced to a device or cavity.

As shown in FIG. 19, cement slurry handling assembly 11*o* may typically be mounted upon the surface 116 of a wall 118 in a fashion similar to the mounting of cement slurry hopper 22 or cement slurry hopper 60, as disclosed herein. Specifically, according to this aspect of the invention, cement slurry hopper 112 may be mounted over the exposed portion 120 of a cavity in the surface 116 of wall 118 above a barrier 124 covering most of the cavity. For example, as disclosed herein, cement slurry hopper 112 may be mounted onto wall 118 where outlet 113 of hopper 112 is at least in partial fluid communication with the exposed portion 120 of the cavity in the surface 116 of wall 118 behind barrier 124. According to this aspect, cement slurry funnel 114 may facilitate the introduction of the cement slurry 115 to the exposed portion 120 of the cavity behind barrier 124 to at least partially fill and repair the cavity with cement slurry 115. Barrier 124 may have all the features and attributes of barrier 16 disclosed herein. For example, barrier 124 may be a piece of plywood mounted to the surface 116 of wall 118 with mechanical fasteners.

Figure 23:
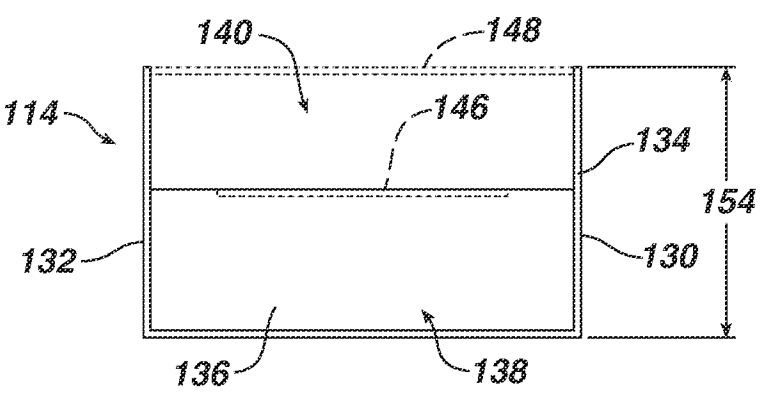
FIG. 23 is a top plan view of the cement slurry funnel shown in FIG. 21.
Figure 22:
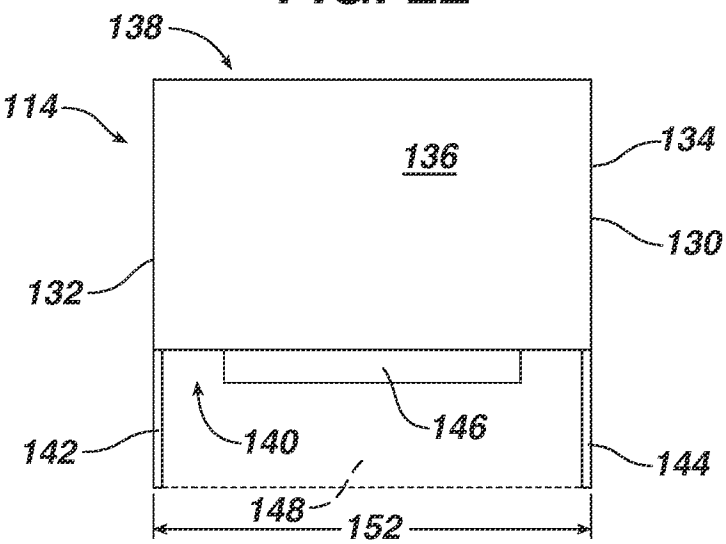
FIG. 22 is a front elevation view of the cement slurry funnel shown in FIG. 21.
Figure 21:
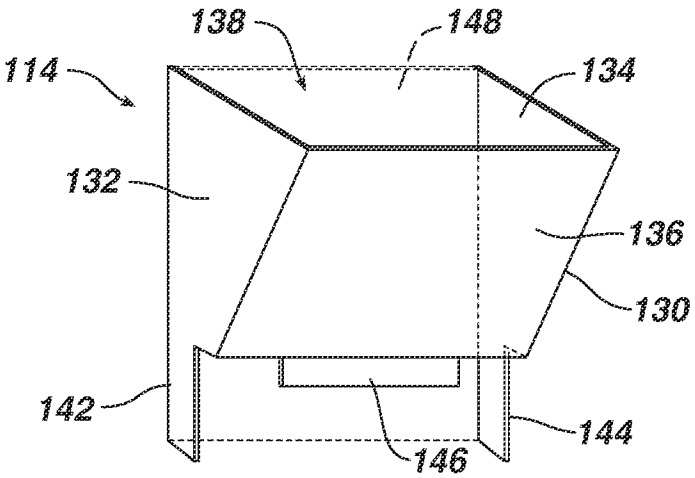
FIG. 21 is a perspective view of the cement slurry funnel shown in FIG. 20.
Figure 24:
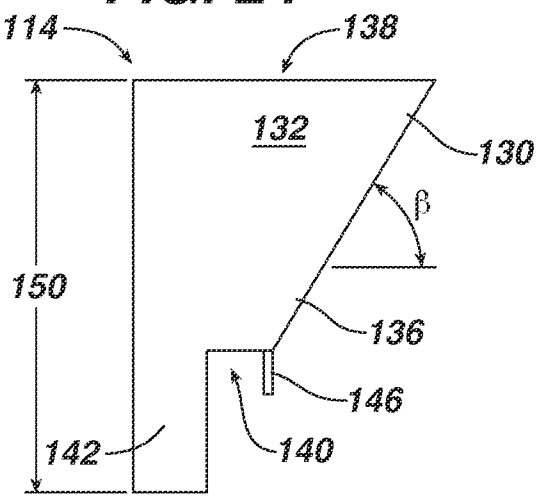
FIG. 24 is a left-side elevation view of the cement slurry funnel shown in FIG. 21, the right-side elevation view being a mirror image thereof.

FIG. 21 is a perspective view of the cement slurry funnel 114 shown in FIG. 20. FIG. 22 is a front elevation view of the cement slurry funnel 114 shown in FIG. 21, and FIG. 23 is a top plan view of the cement slurry funnel 114 shown in FIG. 21. FIG. 24 is a left-side elevation view of the cement slurry funnel 114 shown in FIG. 21, the right-side elevation view being a mirror image thereof.

As shown in FIGS. 21 through 24, in one aspect, cement slurry funnel 114 includes an enclosure 130 having two sides 132 and 134, for example, opposing and substantially vertical sides, and a slanted side 136 between the two opposing vertical sides. The two opposing sides 132 and 134 and the slanted side 136 form an open top 138 adapted to receive a cement slurry and a bottom outlet 140. The slanted side 136 is shaped and positioned to guide the cement slurry, for example, under the force of gravity, to the bottom outlet 140.

In one aspect, cement slurry funnel 114 is adapted to engage a cement slurry hopper, such as, hopper 112 (as shown in FIG. 19), to assist in at least partially securing funnel 114 to the hopper 112 and facilitate use of hopper 112. For example, as shown most clearly in FIG. 21, funnel 114 may include at least two projections 142 and 144, for example, a least two opposing projections, adapted to engage a cement slurry hopper. Each of the at least two opposing projections 142 and 144 may extend from the bottom of one of the slides 132 and 134, and projections 142 and 144 may be positioned, shaped, and adapted to engage an open top of a cement slurry hopper (as shown in FIG. 20). In one aspect, the projections 142 and 144 may be extensions from the bottom of the sides 132 and 134, respectively, for example, comprising the same plate material of sides 132 and 134. In other aspects, projections 142 and 144 may be mounted to sides 132 and 134 by conventional means, for example, with mechanical fasteners, welding, or an adhesive. In one aspect, projections 142 and 144 may comprise one or more plates, as shown, but may also comprise one or more bars, rods, or tubes mounted to sides 132 and 134.

In one aspect, funnel 114 may include one or more projections 146 from a bottom of the slanted side 136.

Projection 146 may be positioned and adapted to engage the open top of a cement hopper. In one aspect, the projection 146 may be an extension from the bottom of slanted side 136, for example, comprising the same plate material of slanted side 136. In other aspects, projection 146 may be mounted to slanted side 136 by conventional means, for example, with mechanical fasteners, welding, or an adhesive. In one aspect, projection 146 may comprise one or more plates, as shown, but may also comprise one or more bars, rods, or tubes mounted to slanted side 136.

As shown most clearly in FIG. 24, slanted side 136 may be oriented at a slant angle β, that is, a slant angle, with respect to a horizontal plane. According to aspects of the invention, slant angle β may range from 15 degrees to 75 degrees, but typically ranges from 30 degrees to 60 degrees, for example, 45 degrees.

In one aspect, cement slurry funnel 114 may include a rear side 148 (shown in phantom), for example, opposite slant side 136 and between sides 132 and 134. Rear side 148 may extend from the open top 140 to the bottom outlet 146 of funnel 114. In one aspect, rear side 148 may extend from the open top 140 to at least partially along the length of projections 142 and 144, or rear side 148 may extend to the entire length or extremity of projections 142 and 144. In one aspect, rear side 148 may provide at least some structural support for projections 142 and 144.

Cement slurry funnel 114 may have a height 150 (see FIG. 24), a width 152 (see FIG. 22), and a depth 154 (see FIG. 23). In one aspect, the height 150 of funnel 114 may range from 3 inches to 36 inches, but typically ranges from 6 inches to 12 inches, for example, 10 inches. In one aspect, width 152 of funnel 114 may range from 6 inches to 36 inches, but typically ranges from 8 inches to 16 inches, for example, 12 inches. In one aspect, the depth 154 of funnel 114 may range from 6 inches to 36 inches, but typically ranges from 8 inches to 16 inches, for example, 12 inches. In one aspect, the thickness of sides 132, 134, 136, and 148 and of projections 142, 144, and 146 may range from ⅛ inch to 2 inches, depending, among other things, upon the size of funnel 114; however, the thickness of these sides and projections may typically range from ¼ inch to W inch, for example, ¼ inch.

According to aspects of the invention, cement slurry funnel 114 may be fabricated from any appropriate material, for example, depending, among other things, upon the size of funnel 114 and the size of the hopper the funnel 114 is used with. For example, funnel 114, including sides 132, 134, 136, and 148 and projections 142, 144, and 146, may be metallic, plastic, or wood. When metallic, funnel 114 may be made from any structural material, for example, steel, stainless steel, aluminum, or titanium. However, funnel 114 may typically be made of steel, for instance, grade A36 steel, or its equivalent. When made of steel, funnel 114, may be fabricated by welding of suitably sized metal plate.

As disclosed herein, methods and devices for repairing surfaces, for example, the surfaces of concrete walls and other concrete structures are provided. Though disclosed with respect to the repair of concrete structures with concrete, aspects of the invention may be used to repair any surface that can be repaired with the use of a flowable binder, including mortar, grout, and asphalt. Aspects of the present invention can overcome the disadvantages of the existing technology by facilitating the repair of surfaces, for example, facilitating the repair of the surfaces of structures having 2 or more cavities. For example, aspects of the invention may be used to repair two or more adjacent cavities that require repair, where aspects of the invention may be used to sequentially repair the two or more cavities, for example, with a single hopper or a single set of a funnel and a hopper.

The terminology used herein is for the purpose of describing particular embodiments only and is not intended to be limiting of the disclosure. As used herein, the singular forms "a", "an," and "the" are intended to include the plural forms as well, unless the context clearly indicates otherwise. It will be further understood that the terms "comprises" and/or "comprising" when used in this specification, specify the presence of the stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. A method for repairing a hole in a surface, the method comprising:

positioning a barrier over a hole in a concrete surface wherein a portion of the hole is not covered by the barrier and wherein the barrier and the hole define a cavity;

mounting a hopper having an open top, sides, and a discharge outlet on to the concrete surface where the discharge outlet is positioned over the portion of the hole not covered by the barrier;

pouring a cement slurry into the open top of the hopper wherein the cement slurry flows through the hopper, out the discharge outlet, into the portion of the hole not covered by the barrier, and into the cavity to substantially completely fill the cavity with cement slurry;

allowing the cement slurry in the cavity to at least partially harden; and removing the hopper and barrier from the concrete surface to reveal a repaired hole in the surface.

2. The method as recited in claim 1, wherein the method further comprises inserting an isolation plate between the portion of the hole not covered by the barrier and the discharge outlet of the hopper.

3. The method as recited in claim 2, wherein inserting the isolation plate comprises sliding the isolation plate within opposing recesses in the hopper.

4. The method as recited in claim 1, wherein allowing the cement slurry in the cavity to at least partially harden comprises allowing the cement slurry in the cavity to substantially completely harden.

5. The method as recited in claim 1, wherein the concrete surface comprises a surface of a concrete wall.

6. The method as recited in claim 1, wherein the barrier comprises at least one of a board, a plate, and a panel.

7. The method as recited in claim 1, wherein positioning the barrier over the hole comprises mounting the barrier to the concrete surface.

8. The method as recited in claim 7, wherein mounting the barrier to the concrete surface comprises mounting the barrier to the surface with a plurality of mechanical fasteners.

9. The method as recited in claim 1, wherein the uncovered portion of the hole is positioned adjacent a top of the hole.

10. The method as recited in claim 1, wherein pouring cement slurry into the open top of the hopper is practiced with a plurality of pours.

11. The method as recited in claim 1, wherein the hopper further comprises a slanted bottom sized and shaped to convey the cement slurry to the cavity.

12. The method as recited in claim 11, wherein the slanted bottom comprises a slant angle $\theta$ from 30 degrees to 60 degrees.

13. The method as recited in claim 1, wherein the sides of the hopper comprise opposing sidewalls comprising a slant angle $\alpha$ from 30 degrees to 60 degrees.

14. The method as recited in claim 1, wherein the cement slurry comprises a class D concrete slurry.

15. The method as recited in claim 1, wherein the concrete surface comprises one of a vertical surface and a non-vertical surface.

16. The method as recited in claim 15, wherein the non-vertical concrete surface comprises a plane making an angle from plus 45 degrees to minus 45 degrees from vertical.

17. The method as recited in claim 1, wherein pouring the cement slurry into the open top of the hopper comprises pouring the cement slurry with the aid of at least one of gravity and pressure.

18. The method as recited in claim 1, wherein the method further comprises, after removing the hopper and barrier from the concrete surface, finishing the concrete surface.

19. The method as recited in claim 18, wherein finishing the concrete surface comprises at least one of filling unfilled voids in the concrete surface with cement slurry and removing excess at least partially hardened cement slurry from the concrete surface.

20. The method as recited in claim 1, wherein pouring the cement slurry into the open top of the hopper comprises introducing the slurry to the open top of the hopper with a cement slurry funnel.

* * * * *